US007920814B2

(12) United States Patent
Atwood et al.

(10) Patent No.: US 7,920,814 B2
(45) Date of Patent: Apr. 5, 2011

(54) INTERMEDIATE TRANSFER BELT STEERING SYSTEM

(75) Inventors: Mark A. Atwood, Rush, NY (US); James P. Calamita, Spencerport, NY (US); Andrey Podzorov, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 155 days.

(21) Appl. No.: 12/361,751

(22) Filed: Jan. 29, 2009

(65) Prior Publication Data

US 2010/0189475 A1 Jul. 29, 2010

(51) Int. Cl.
*G03G 15/01* (2006.01)

(52) U.S. Cl. ..... 399/302

(58) Field of Classification Search ..... 399/162, 399/165, 302, 303, 308, 312, 313
See application file for complete search history.

(56) References Cited

U.S. PATENT DOCUMENTS 5,225,877 A 7/1993 Wong
5,248,027 A 9/1993 Kluger et al.
5,515,139 A 5/1996 Hou et al.
5,978,003 A 11/1999 Brenner, Jr.
6,275,244 B1 8/2001 Omelchenko et al.
6,300,968 B1 10/2001 Kerxhalli et al.
6,369,842 B1 4/2002 Abramsohn
6,594,460 B1 7/2003 Williams et al.
6,871,036 B2 * 3/2005 Asuwa et al. ..... 399/302
6,934,497 B2 8/2005 Hagiwara et al.
2003/0108369 A1 6/2003 Kuo et al.
2006/0289280 A1 * 12/2006 Furuya et al. ..... 198/806
2008/0025744 A1 1/2008 Miyamoto et al.

* cited by examiner

*Primary Examiner* — Sandra L Brase
(74) *Attorney, Agent, or Firm* — Gibb I.P. Law Firm, LLC

(57) ABSTRACT

Disclosed are embodiments that use multiple, belt-steering systems to control and maintain alignment of an endless belt. The position of the edge of the belt is measured by multiple belt edge sensors and then corrected by at least two steering rollers connected to corresponding steering mechanisms. The steering mechanisms tilt the rollers in order to selectively adjust the lateral position of the belt. Steering can be controlled independently with the tilt of each steering roller being adjusted based solely on information obtain from a corresponding belt edge sensor. Alternatively, steering can be controlled dependently with the tilt of each steering roller being adjusted based on information obtain from multiple sensors at multiple locations and further based on the predictable impact of the simultaneous movement of both rollers on belt positioning. In addition, at least one of the steering rollers can also be configured as a drive roller.

20 Claims, 7 Drawing Sheets

INTERMEDIATE TRANSFER BELT STEERING SYSTEM

BACKGROUND AND SUMMARY

Embodiments herein generally relate to electrostatic printing devices and, more particularly, to an electrostatic printing device having multiple steering systems for accurately maintaining lateral alignment of an endless intermediate transfer belt (ITB).

Many multi-color electrostatic printing devices incorporate the use of an endless intermediate transfer belt (ITB). Typically, during an ITB print operation, the ITB passes through multiple different color imaging stations positioned in series along the ITB circumference in order to create a full-color image on the ITB surface. The full-color image is then transferred from the ITB to a print medium (e.g., a sheet of paper) at a belt-to-print medium (BTP) transfer station. Thus, lateral alignment of the ITB is critical to ensure proper image-on-print medium (IOP) registration and proper color-to-color registration. In an attempt to achieve lateral ITB alignment, many printing devices incorporate a belt steering system (also referred to as a belt positioning system, a belt position tracking and correction system, etc.) to reduce deviation of the belt from its desired transport path. Various types of belt steering systems are known in the art. Typically, such belt steering systems use a single steering roller with a tilt mechanism that corrects the lateral position of the ITB, as measured by a belt edge sensor located, for example, adjacent to (i.e., near) the steering roller. Unfortunately, since such belt steering systems make corrections at only one location around the belt circumference, they are not sufficient to maintain the lateral alignment of the ITB as it passes through the multiple imaging stations and through the BTP transfer station. The resulting lateral skew of the ITB, for example, between the steering roller and the BTP transfer station and further between the different imaging stations can result in IOP registration errors and color-to-color registration errors.

In view of the foregoing, disclosed herein are embodiments of an apparatus that uses multiple belt steering systems to control and maintain lateral alignment of an endless belt. For example, the apparatus can comprise a printing apparatus that uses multiple belt steering systems to control and maintain lateral alignment of an endless intermediate transfer belt (ITB). In each of the embodiments, the position of the lateral edge of the belt is measured by multiple belt edge sensors and then corrected by at least two steering rollers connected to corresponding belt steering mechanisms. The belt steering mechanisms tilt the rollers in order to adjust the lateral position of the belt at multiple locations. The steering mechanisms for the rollers can be controlled independently with the tilt of each steering roller being adjusted based solely on information obtain from a corresponding belt edge sensor. Alternatively, the steering mechanisms for the rollers can be controlled dependently with the tilt of each steering roller being adjusted based on information obtain from multiple sensors at multiple locations and further based on the predictable impact of the simultaneous movement of both rollers on belt positioning. In addition, to save space, at least one of the steering rollers can also be configured as a drive roller that causes the belt to travel in a given direction.

More particularly, disclosed herein are embodiments of an apparatus that comprises an endless belt. For example, the apparatus can comprise a printing apparatus (e.g., an electrostatic printer, a xerographic printer, etc.). This printing apparatus can comprise an endless intermediate transfer belt (ITB), a plurality of imaging stations positioned in series adjacent to the outer surface of the ITB and a belt-to-print medium (BTP) transfer station also position adjacent to the outer surface of the ITB. In operation, the ITB can travel in a given direction through the multiple imaging stations in order to create a full-color image on the ITB surface. The full-color image can then be transferred from the ITB to a print medium (e.g., a sheet of paper) at the BTP transfer station.

In order to ensure lateral alignment of the endless belt during operation (e.g., in the case of the printing apparatus described above or in the case of some other apparatus that incorporates the use of an endless belt), the embodiments of the apparatus disclosed herein can comprise multiple steering rollers. Each of these multiple steering rollers can be configured with a discrete corresponding steering mechanism. These steering mechanisms can be controlled, in response to sensor measurements, by either discrete corresponding controllers or a single controller.

Specifically, in the embodiments disclosed herein the endless belt can be supported, at least in part, by multiple steering rollers. That is, the inner surface of the endless belt can contact at least a portion of the outer surface of each steering roller. The multiple steering rollers can comprise at least a first steering roller and a second steering roller that are located at different positions with respect to the belt and that are separated from each other by some predetermined distance. The first steering roller can have a first outer surface in contact with the inner belt surface. The first steering roller can further have a first axle with a first fixed end and a first movable end. The first moveable end can be operatively connected to a first actuator (e.g., a first cam-follower system) capable of moving the first movable end in a given actuation direction such that the first axle and, thereby, the first steering roller tilts (i.e., pivots, moves, etc.) with respect to a first pivot point at the first fixed end. By tilting the first steering roller at a specific angle with respect to the first pivot point as the belt travels over the first steering roller, the lateral position of the belt on the first steering roller can be selectively adjusted. Similarly, the second steering roller can have a second outer surface in contact with the inner belt surface. The second steering roller can further have a second axle with a second fixed end and a second movable end. The second moveable end can be operatively connected to a second actuator (e.g., a second cam-follower system) capable of moving the second movable end in a given actuation direction such that the second axle and, thereby the second steering roller tilts (i.e., pivots, moves, etc.) with respect to a second pivot point at the second fixed end. By tilting the second steering roller at a specific angle with respect to the second pivot point as the belt travels over the second steering roller, the lateral position of the belt on the second steering roller can be selectively adjusted. Thus, in order to maintain lateral alignment of the belt as it travels in a given direction over the rollers, one or more controllers are used to control the movement (i.e., the tilting or pivoting) of the first steering roller with respect to the first pivot point as well as to control movement (i.e., the tilting or pivoting) of the second steering roller with respect to the second pivot point. The different apparatus embodiments disclosed herein vary with respect to how movement of the first and second steering rollers about their respective pivot points is controlled: independently or dependently.

In one embodiment, the apparatus can comprise a first sensor and a second sensor. The first sensor can be positioned at a first location adjacent to the first steering roller and the second sensor can be positioned at a second location adjacent to the second steering roller. The first sensor can determine (i.e., sense, measure, etc.) the position of a lateral edge of the belt at the first location (i.e., can determine a first lateral position of the belt). The first sensor can communicate the first lateral position to a controller. The controller can compare the first lateral position to a desired position for the lateral edge of the belt at that first location. Then, the controller can determine a first pivot angle for moving (i.e., tilting or pivoting) the first steering roller in order to return the belt and, more particularly, to return the lateral edge of the belt at the first location to the desired position. Similarly, a second sensor can determine (i.e., sense, measure, etc.) the position of the same lateral edge of the belt at a second location adjacent to the second steering roller (i.e., can determine a second lateral position of the belt). The second sensor can communicate the second lateral position to a controller. The controller can compare the second lateral position to the desired position for lateral edge of the belt at that second location. Then, the controller can determine a second pivot angle for moving (i.e., tilting or pivoting) the second steering roller in order to return the lateral edge of the belt at the second location to the desired position. In this embodiment, either the same controller or discrete controllers (i.e., a first controller for controlling tilt of the first steering roller and a second controller for controlling tilt of the second steering roller) can be used to compare the measured first and second lateral positions to the desired positions and to determine the required pivot angles. However, such processes are performed independently. That is, the determined pivot angle for the first steering roller is not dependent on the determine pivot angle for the second steering roller or vice versa. Once the controller(s) determine the required pivot angles for the first and second steering rollers, the controller(s) can control the corresponding first and second actuators accordingly in order to move (i.e., tilt, pivot, etc.) the first and second moveable ends to the first and second pivot angles, respectively, and, thereby to adjust belt positioning. Consequently, in this embodiment, the first lateral position of the belt at the first location and the second lateral position of the belt at the second location are independently adjusted.

Alternatively, in another embodiment, a plurality of sensors can determine (i.e., measure, sense, etc.) the positions of the lateral edge of the belt at multiple locations. For example, a first sensor can determine a first lateral position of the edge of the belt at a first location adjacent to the first steering roller, a second sensor can determine a second lateral position of the edge of the belt at a second location adjacent to the second steering roller, and (optionally) additional sensors can determine additional lateral positions of the edge of the belt at additional locations. The sensors can communicate these lateral positions to a single controller. The single controller can compare the positions of the lateral edge of the belt at the multiple locations, as measured, to desired positions for the lateral edge at these multiple locations. Then, in order to return the belt and, more particularly, the lateral edge of the belt at these multiple locations to the desired positions, the controller can determine a first pivot angle for the first steering roller and a second pivot angle for the second steering roller. This determination can be made by the controller based on the predictable impact of movement of both the first steering roller and the second steering roller on belt edge positioning. That is, correcting the position of the belt edge at one location by moving a steering roller may have a predictable impact on the positioning of the belt edge at another location and vice versa. Thus, the best pivot angles for moving the first and second steering rollers in order to achieve the desired lateral belt alignment can be determined based on knowledge of the relationship between the two steering rollers and how their movement in combination will impact belt positioning. Once the controller determines the required pivot angles for the first and second steering rollers, the controller can control the corresponding first and second actuators accordingly in order to move (i.e., tilt, pivot, etc.) the first and second moveable ends to the first and second pivot angles, respectively, and, thereby to adjust belt positioning. Consequently, in this embodiment, the first lateral position of the belt at the first location and the second lateral position of the belt at the second location are dependently adjusted.

In order to optimize space within the printing apparatus embodiments described above, one of the steering rollers (e.g., the first steering roller) can further be configured as a drive roller. Rotation of the drive roller in a given direction (e.g., a counter clockwise direction or, alternatively, a clockwise direction) will cause the belt to travel in that same direction. Movement of the belt in turn can cause the second steering roller to rotate about its axle. In order to configure the first steering roller as a drive roller, a drive motor can be operatively connected to the first axle adjacent to the first fixed end so as to rotate the first steering roller. However, if the first steering roller does function as both a steering roller and a drive roller, the apparatus must further comprise a flexible mount for mounting the drive motor and allowing for movement of the first steering roller with respect to the first pivot point in the presence of the drive motor. This flexible mount, which secures the drive motor within the printing apparatus adjacent to the first steering roller, must be adapted to allow either the entire mount itself or the drive motor within the mount to move (i.e., to be tilted or pivoted) in conjunction with the movement of first steering roller and, more particularly, in conjunction with movement of the first movable end of the first axle of the first steering roller.

These and other features are described in, or are apparent from, the following detailed description.

BRIEF DESCRIPTION OF THE DRAWINGS

Various exemplary embodiments of systems and methods are described in detail below, with reference to the attached drawing figures, in which.

DETAILED DESCRIPTION

The embodiments and the various features and advantageous details thereof are explained more fully with reference to the non-limiting embodiments that are illustrated in the accompanying drawings and detailed in the following description.

Figure 5:
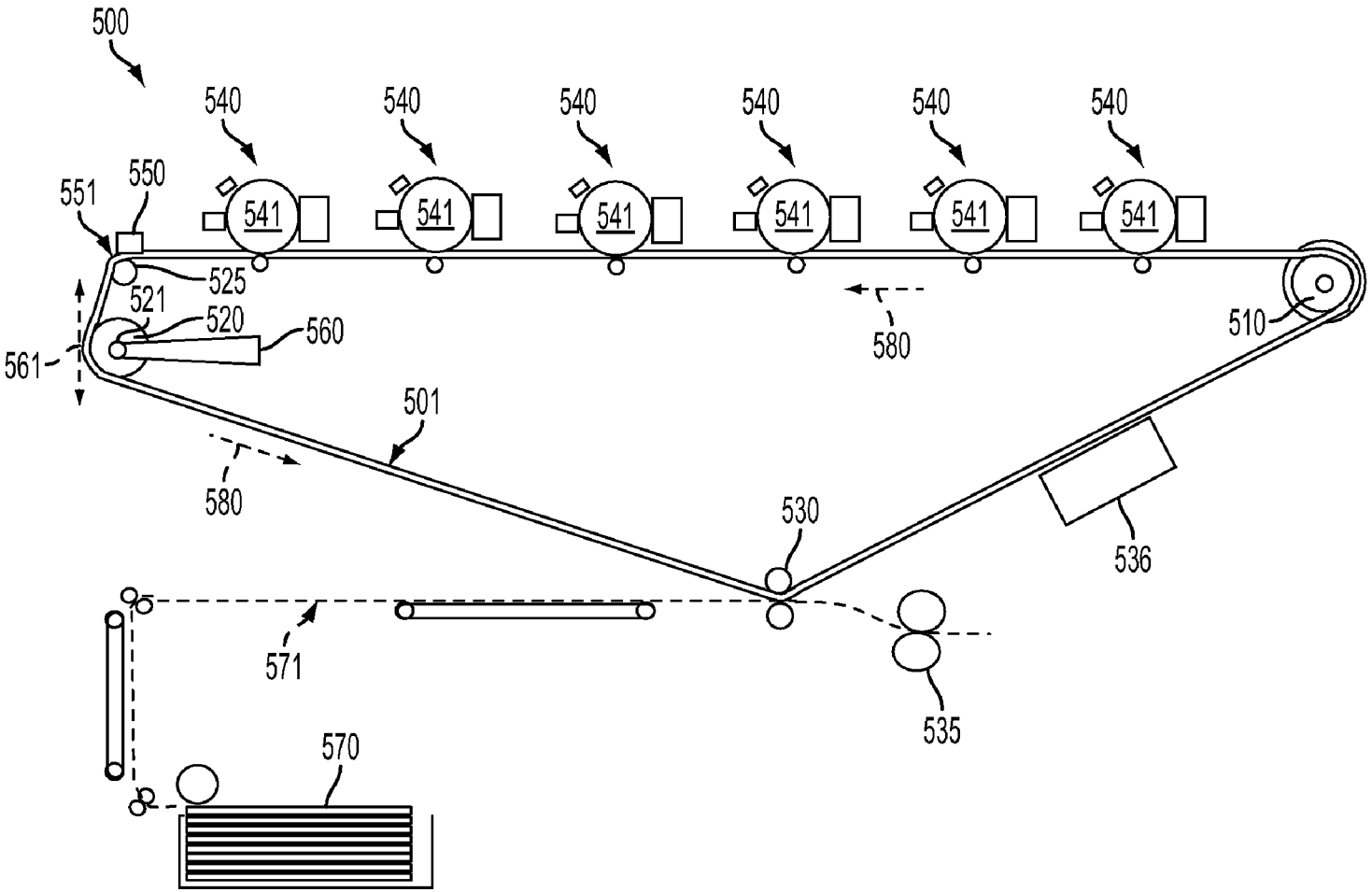
FIG. 5 is a schematic diagram of a printing apparatus.

Many multi-color electrostatic printing devices incorporate the use of an endless intermediate transfer belt (ITB) (e.g., as described in detail in U.S. Patent Application Publication No. 2003/0108369 of Kuo, et al., published on Jun. 12, 2003, the complete disclosure of which is incorporated herein by reference). FIG. 5 is a simplified view of an exemplary multi-color printing device 500. In such printing devices 500, the ITB 501 is typically supported by one or more rollers, including but not limited to, guide roller(s) (also referred to as tension rollers) 525, a steering roller 520, and a drive roller 510. Additionally, such printing devices 500 can comprise multiple different color imaging stations 540 (e.g., four, six, eight, etc. imaging stations) positioned in series along the ITB 501 circumference. As the ITB 501 travels in a given direction 580 it passes through these multiple imaging stations 540 in order to create a full-color toner image in an image area on the ITB outer surface. Specifically, each imaging station 540 has a separate photoreceptor drum 541 for transferring an image of a specific color onto the ITB 501 in a defined image area. In four-color printing, these colors typically comprise yellow (Y), magenta (M), cyan (C), and black (K). In six-color or eight-color printing, these colors typically comprise YMCK and two or four additional colors, respectively, for enhanced image quality. The additional colors can include, for example, completely different colors (e.g., green or orange) or lighter tones of YMCK. Those skilled in the art will recognize that increasing the number of imaging stations through which the endless ITB must travel increases the required length of the ITB, for a given size of imaging station 540.

Once the full-color toner image is formed on the ITB 501, a print medium 570 is fed along a print medium transport path 571 to a belt-to-print medium (BTP) transfer station 530, where it is brought into contact or at least proximity with the full-color image on the ITB 501 surface. At the BTP transfer station 530, a corotron or other charge generating device causes the full-color image on the ITB 501 to be electrostatically transferred to the print medium 570. The print medium 570 is then forwarded to subsequent stations, as is familiar in the art, including a fusing apparatus 535 which permanently fixes the image to the print medium 570. From the fusing apparatus 535, the print medium 570 may be transported to a feeder and then to an output tray (not shown). Following the transfer of the full-color toner image from the ITB 501 to the print medium 570, any residual toner particles remaining on the surface of the ITB 501 can be removed by a cleaning apparatus 536.

As mentioned above, during an ITB print operation, the ITB 501 passes through multiple imaging stations 540 in series in order to create the full-color image on the ITB 501 surface. Thus, lateral alignment of the ITB 501 is critical to ensure proper image-on-print medium (IOP) registration and color-to-color registration. Here, lateral alignment refers to the positioning of the ITB 501 in the plane of the ITB and normal to the direction of travel of the ITB 501 (into and out of the page as shown in FIG. 5). To achieve lateral alignment, many printing devices incorporate a belt steering system (also referred to as a belt positioning system, a belt position tracking and correction system, etc.) to reduce deviation of the belt from its desired transport path. Various types of belt steering systems are known in the art. Exemplary belt steering systems are discussed in detail in the following U.S. patents assigned to Xerox Corporation of Norwalk, Conn., and incorporated herein in their entirety by reference: U.S. Pat. No. 5,248,027 of Kluger, et al., issued on Sep. 28, 1993; U.S. Pat. No. 6,594,460 of Williams, et al., issued on Jul. 15, 2003; U.S. Pat. No. 5,225,877, of Wong, issued on Jul. 6, 1993; and U.S. Pat. No. 5,515,139 of Hou et al., issued on May 7, 1996.

Generally, such belt steering systems use a single steering roller 520 with a tilt mechanism 560 to correct the lateral position of the ITB 501. The steering roller 520 is freely rotatable about its axle 521. Additionally, it is configured so that it is capable of pivotal movement (i.e., tilting) about a soft axis that is out of plane with the ITB 501. For example, the axle 521 can be mounted so that at least one end of the roller 520 can be moved (i.e., tilted, pivoted, etc.) in a given actuation direction 561. By moving (i.e., tilting, pivoting, etc.) the steering roller 520 as the belt travels over it, the lateral position of the belt on the steering roller 520 can be adjusted. Unfortunately, such belt steering systems, having steering to correct belt edge positioning at only one location around the ITB 501 circumference, are not sufficient to maintain lateral belt alignment through the multiple imaging stations 540 and through the BTP transfer station 530. This is especially true in architecture configurations where there are a large number of imaging stations 540 (more than 4) since the length of the belt increases significantly. Specifically, belt steering systems allow the steering roller 520 to correct for lateral belt skew. However, as discussed above, the correction is made at only one location by only one steering roller 520 and is typically made based on information from only one sensor 550 positioned at a location 521 near the steering roller 520. Therefore, such belt steering systems are capable of maintaining the desired lateral position of the edge of the ITB at the one location 521 only. However, as a function of the increased length of the ITB 501 due to multiple imaging stations and as a function of the presence of other disturbances (e.g., disturbances caused by print media 570 passing through the BTP transfer station 530 along with the ITB 501), the lateral position of the ITB 501 at other locations along the belt circumference may be skewed and may cause IOP registration errors or color-to-color registration errors.

Figure 6A:
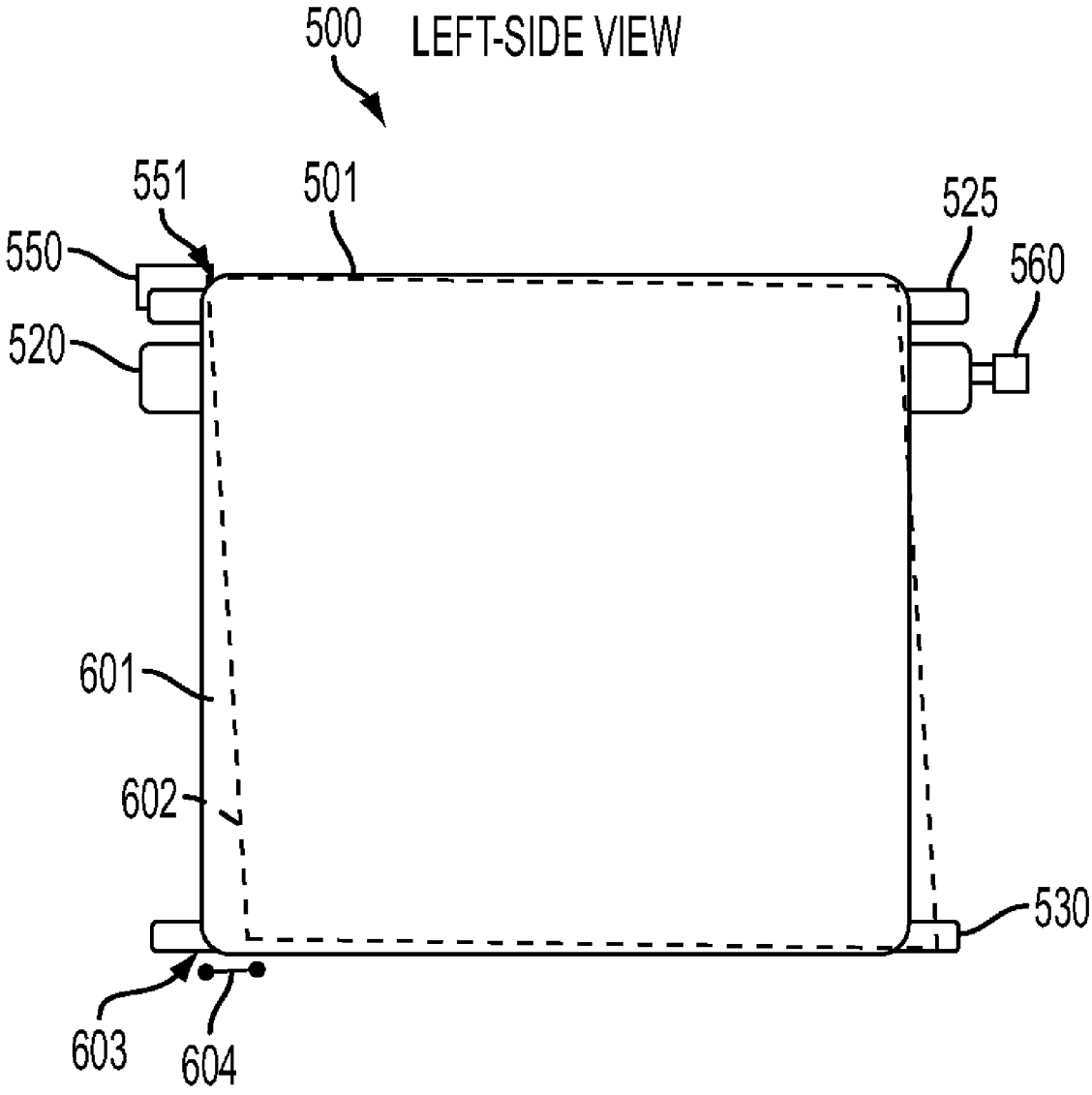
FIG. 6*a* is a side-view diagram of the printing apparatus of FIG. 6.
Figure 6B:
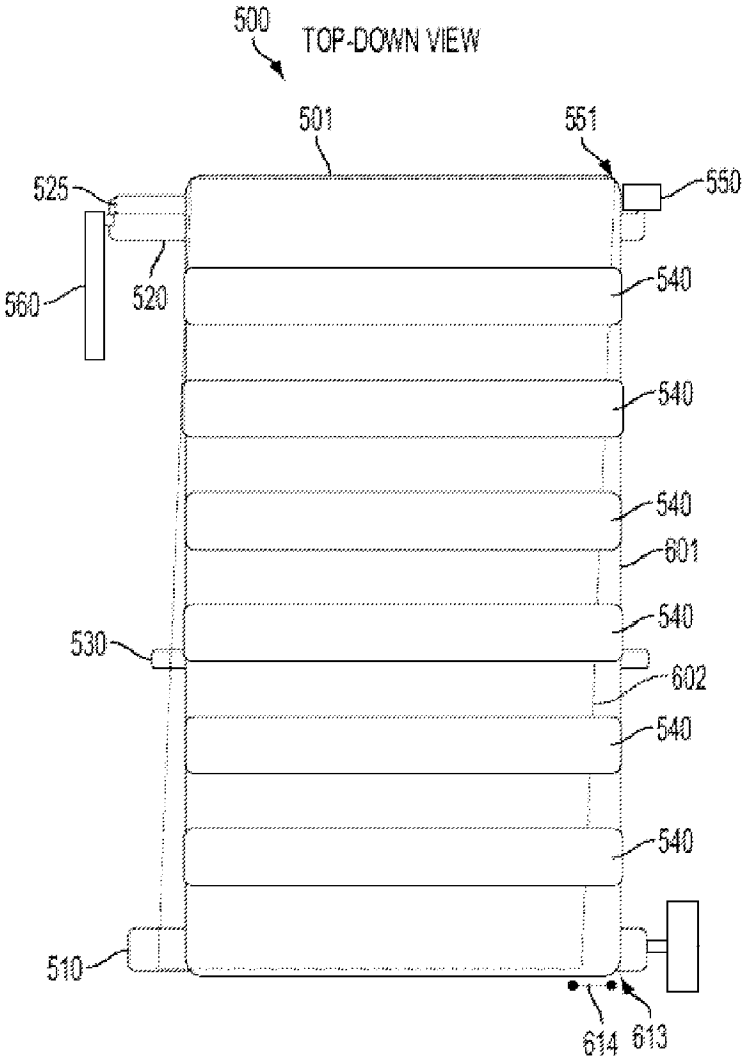
FIG. 6*b* is a top-view diagram of the printing apparatus of FIG. 6.

More specifically, as a print medium enters the transfer station 530, there can be a shift in the ITB 501 in the lateral direction. A conventional belt steering system will compensate for the lateral shift of the ITB (i.e., for skew) at the location 521 near the steering roller 520. However, this belt steering system will not compensate for skew that occurs between the steering roller 520 and the BTP transfer station 530. For example, as illustrated in the left-side view of the printing apparatus 500 shown in FIG. 6*a* and the top-down view of the printing apparatus 500 shown in FIG. 6*b*, at the location 551 of the belt edge sensor 550 near the steering roller 520, the lateral edge of the ITB can be adjusted so that the actual position 602 and the desired position 601 of the edge are essentially the same. However, FIG. 6*a* illustrates that at a location 603, which is distant from the steering roller 520 and near the transfer station 630, the actual belt edge position 602 may remain skewed from the desired belt edge position 601 by a distance 604. Similarly, FIG. 6*b* illustrates that at a location 613, which is distant from the steering roller 520 and near the drive roller 510, the actual belt edge position 602 can remain skewed from the desired belt edge position 601 by a distance 614. Skew in the belt edge between the steering roller 520 and the BTP transfer station 530 can result in IOP registration errors, whereas skew in the belt edge between drive roller 510 and 520 as the ITB 501 passes through the different imaging stations 540 can result in color-to-color registration errors.

In view of the foregoing, disclosed herein are embodiments of an apparatus that uses multiple belt steering systems to control and maintain lateral alignment of an endless belt. For example, the apparatus can comprise a printing apparatus that uses multiple belt steering systems to control and maintain lateral alignment of an endless intermediate transfer belt (ITB). In each of the embodiments, the position of the lateral edge of the belt is measured by multiple belt edge sensors and then corrected by at least two steering rollers connected to corresponding belt steering mechanisms. The belt steering mechanisms tilt the rollers in order to adjust the lateral position of the belt at multiple locations. The steering mechanisms for the rollers can be controlled independently with the tilt of each steering roller being adjusted based solely on information obtain from a corresponding belt edge sensor. Alternatively, the steering mechanisms for the rollers can be controlled dependently with the tilt of each steering roller being adjusted based on information obtain from multiple sensors at multiple locations and further based on the predictable impact of the simultaneous movement of both rollers on belt positioning. In addition, to save space, at least one of the steering rollers can also be configured as a drive roller that causes the belt to travel in a given direction.

Figure 1:
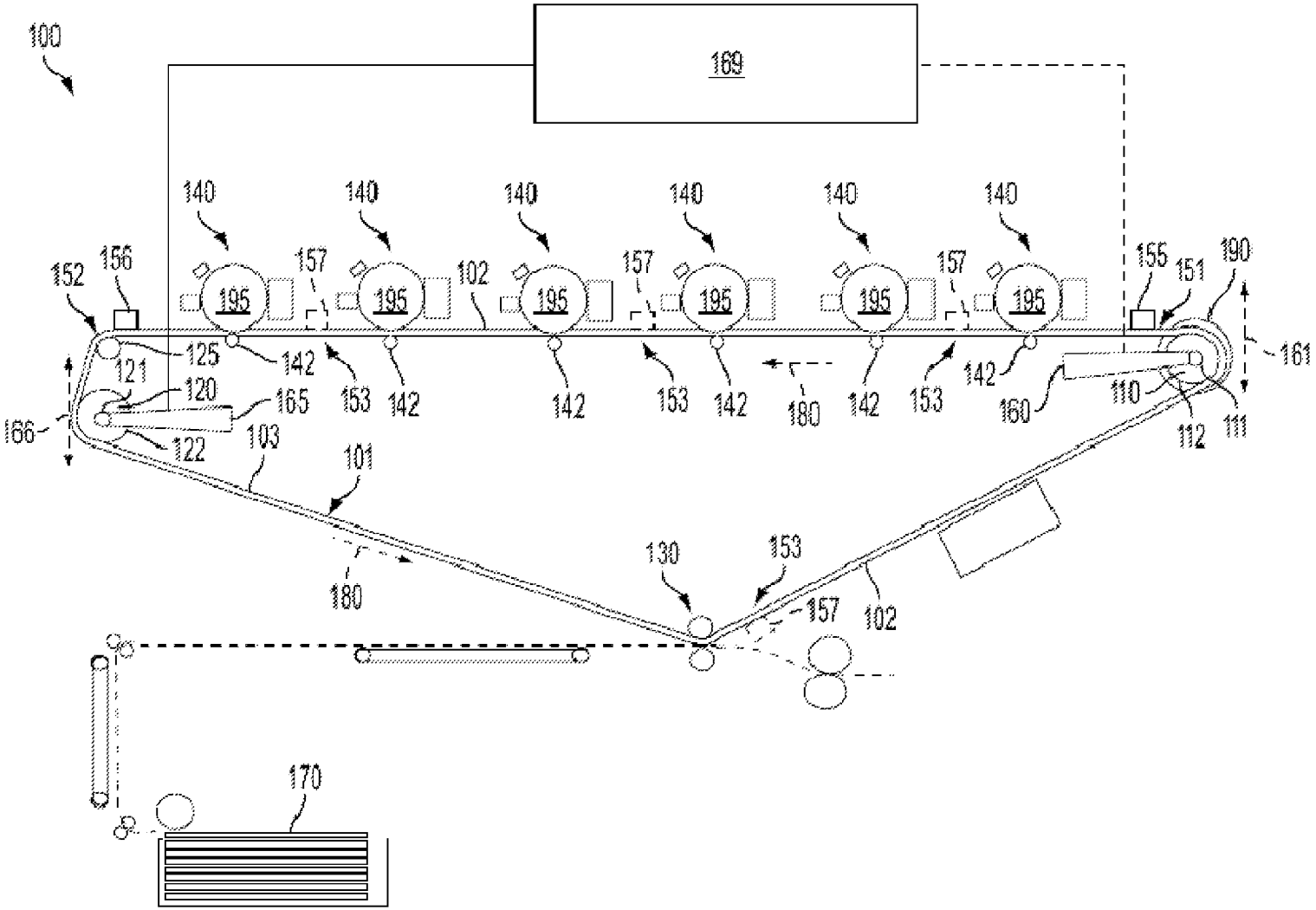
FIG. 1 is a schematic diagram of a printing apparatus according to embodiments herein.

More particularly, referring to FIG. 1, disclosed herein are embodiments of an apparatus 100 that comprises an endless belt 101. In order to ensure lateral alignment of the endless belt 101 during operation of the apparatus 100, the embodiments further comprise multiple steering rollers (e.g., first steering roller 110 and second steering roller 120). Each of these multiple steering rollers 110, 120 can be configured with a discrete corresponding steering mechanism 160, 165. These steering mechanisms 160, 165 can be controlled, in response to sensor measurements, by either discrete corresponding controllers or a single controller 169 (as illustrated).

For example, the apparatus 100 can comprise a printing apparatus (e.g., an electrostatic printer, a Xerographic printer, etc.) and the endless belt 101 can comprise an intermediate transfer belt (ITB) 101. The ITB 101 can be supported by the steering rollers 110, 120 and can further travel over the steering rollers 110, 120 in a given direction 180 (e.g., a counter clockwise direction, as illustrated, or alternatively a clockwise direction). Imaging stations 140 can be positioned in series on one side of the rollers 110, 120 adjacent to the outer belt surface 102, as the ITB 101 travels from the first steering roller 110 towards the second steering roller 120 in the given direction 180. A belt-to-print medium (BTP) transfer station 130 can be positioned on the opposite side of the rollers 110, 120 adjacent to the outer belt surface 102, as the ITB travels from the second steering roller 120 back towards the first steering roller 110 in the given direction 180. During operation of the printing apparatus, the ITB 101 can travel in the given direction 180 through the multiple imaging stations 140 in order to create a full-color image in an image area on the ITB 101 outer surface 102. The full-color image can then be transferred from the ITB 101 to a print medium 170 (e.g., a sheet of paper) at the BTP transfer station 130. As mentioned above, belt steering systems with steering at only one location around the ITB circumference are not sufficient to maintain the lateral alignment of the ITB as it passes through multiple imaging stations 140 and through a BTP transfer station 130. Thus, the embodiments use the multiple steering rollers 110, 120 to control and maintain lateral alignment of an endless intermediate transfer belt (ITB) 101.

Figure 2A:
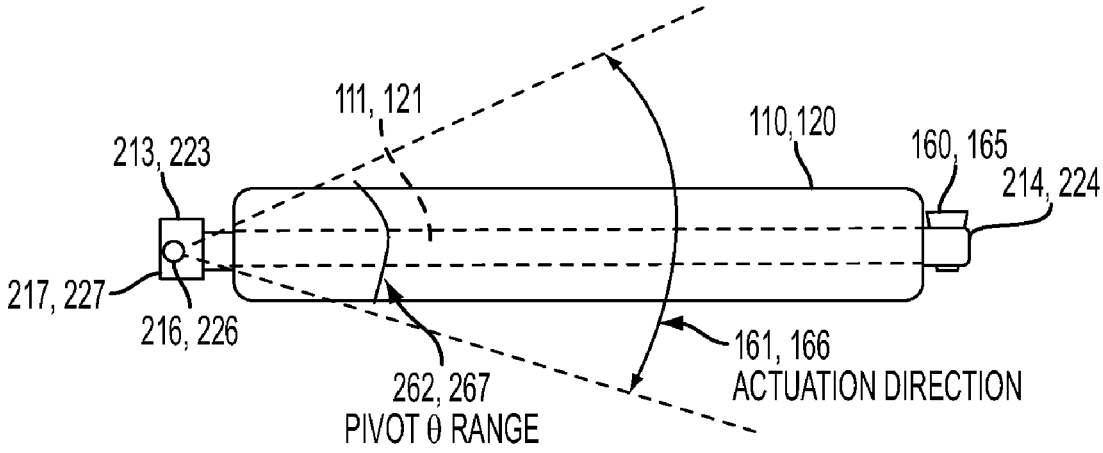
FIG. 2*a* is a schematic cross-section diagram of a steering roller.
Figure 2B:
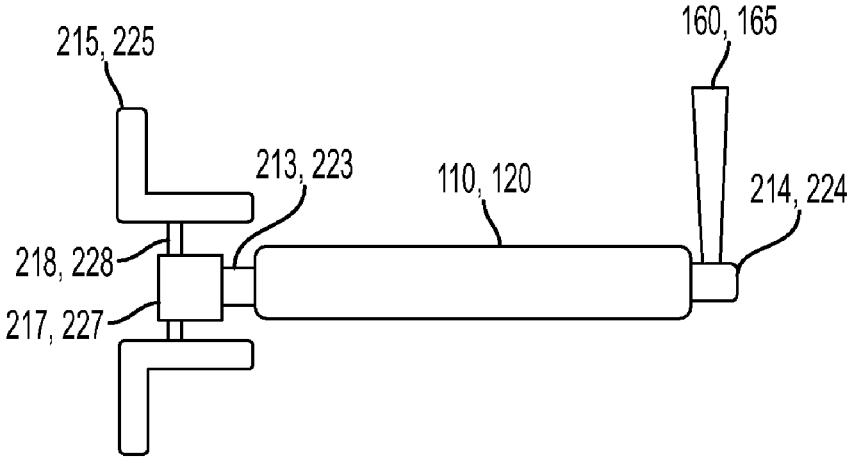
FIG. 2*b* is a schematic top-view diagram of the steering roller of FIG. 2*b;*

Specifically, referring to FIGS. 2*a* and 2*b* in combination with FIG. 1, in the embodiments disclosed herein the endless belt 101 can be supported, at least in part, by multiple steering rollers 110, 120. That is, the inner surface 103 of the endless belt 101 can contact at least a portion of the outer surface 112, 122 of each steering roller 110, 120, thus allowing the belt to travel in a circular manner and in a given direction 180 (e.g., a counter clockwise direction, as illustrated, or alternatively a clockwise direction) around the rollers 110, 120. The multiple steering rollers 110, 120 can be located at different positions with respect to the belt 101 and can be separated from each other by some predetermined distance.

The first steering roller 110 can have a first outer surface 112 in contact with the inner belt surface 103. The first steering roller 110 can further have a first axle 111 with a first fixed end 213 and a first movable end 214 (see the cross-section and top view diagrams of steering roller 110 in FIGS. 2*a* and 2*b*, respectively). The first fixed end 213 can be mounted within the apparatus 100 using a first pivot mount 215 (i.e., a first pivot connection) that allows the fixed end 213 to remain in a fixed position and the movable end 214 to pivot within a given pivot angle range 262 about that fixed position (i.e., about the first pivot point 216). The first moveable end 214 can further be operatively connected to a first actuator 160 (e.g., a first cam-follower system) capable of moving the first movable end 214 in a given actuation direction 161 such that the first axle 111 and, thereby, the first steering roller 110 tilts (i.e., pivots, moves, etc.) with respect to a first pivot point 216 at the first fixed end 213. By tilting the first steering roller 110 at a specific angle with respect to the first pivot point 216 as the belt 101 travels over the first steering roller 110, the lateral position of the belt 101 on the first steering roller 110 can be selectively adjusted.

Similarly, the second steering roller 120 can have a second outer surface 122 in contact with the inner belt surface 103. The second steering roller 120 can further have a second axle 121 with a second fixed end 223 and a second movable end 224 (see the cross-section and top view diagrams of steering roller 120 in FIGS. 2*a* and 2*b*, respectively). The second fixed 223 can be mounted within the apparatus 100 using a second pivot mount 225 (i.e., a second pivot connection) that allows the fixed end 223 to remain in a fixed position and the movable end 224 to pivot within a given pivot angle range 267 about that fixed position (i.e., about the second pivot point 226). The second moveable end 224 can be operatively connected to a second actuator 165 (e.g., a second cam-follower system) capable of moving the second movable end 224 in a given actuation direction 166 such that the second axle 121 and, thereby the second steering roller 120 tilts (i.e., pivots, moves, etc.) with respect to a second pivot point 226 at the second fixed end 223. By tilting the second steering roller 120 at a specific angle with respect to the second pivot point 226 as the belt 101 travels over the second steering roller 120, the lateral position of the belt 101 on the second steering roller 120 can be selectively adjusted.

Suitable pivot mounts 215, 225 can comprise, for example, a pin(s) 218, 228 (i.e., shaft(s), rod(s), etc.) attached to a bracket. The pin(s) 218, 228 can be directly connected to the end 213, 223 of the axle 111, 121 so as to fix the end 213, 223 and further so as to allow the axle 111, 121 to pivot about the pin(s) 218, 228. In this case, rotation of the rollers 110, 120 would necessarily be about a fixed axle 111, 121. Alternatively, the end 213, 223 of the axle 111, 121 can be inserted into a bushing 217, 227 such that the axle 111, 121 is secured to, but can rotate freely within the bushing 217, 227. Pin(s) 218, 228 can be connected to the bushing 217, 227 so as to further allow the axle 111, 121 to pivot at that end 213, 223.

Figure 3:
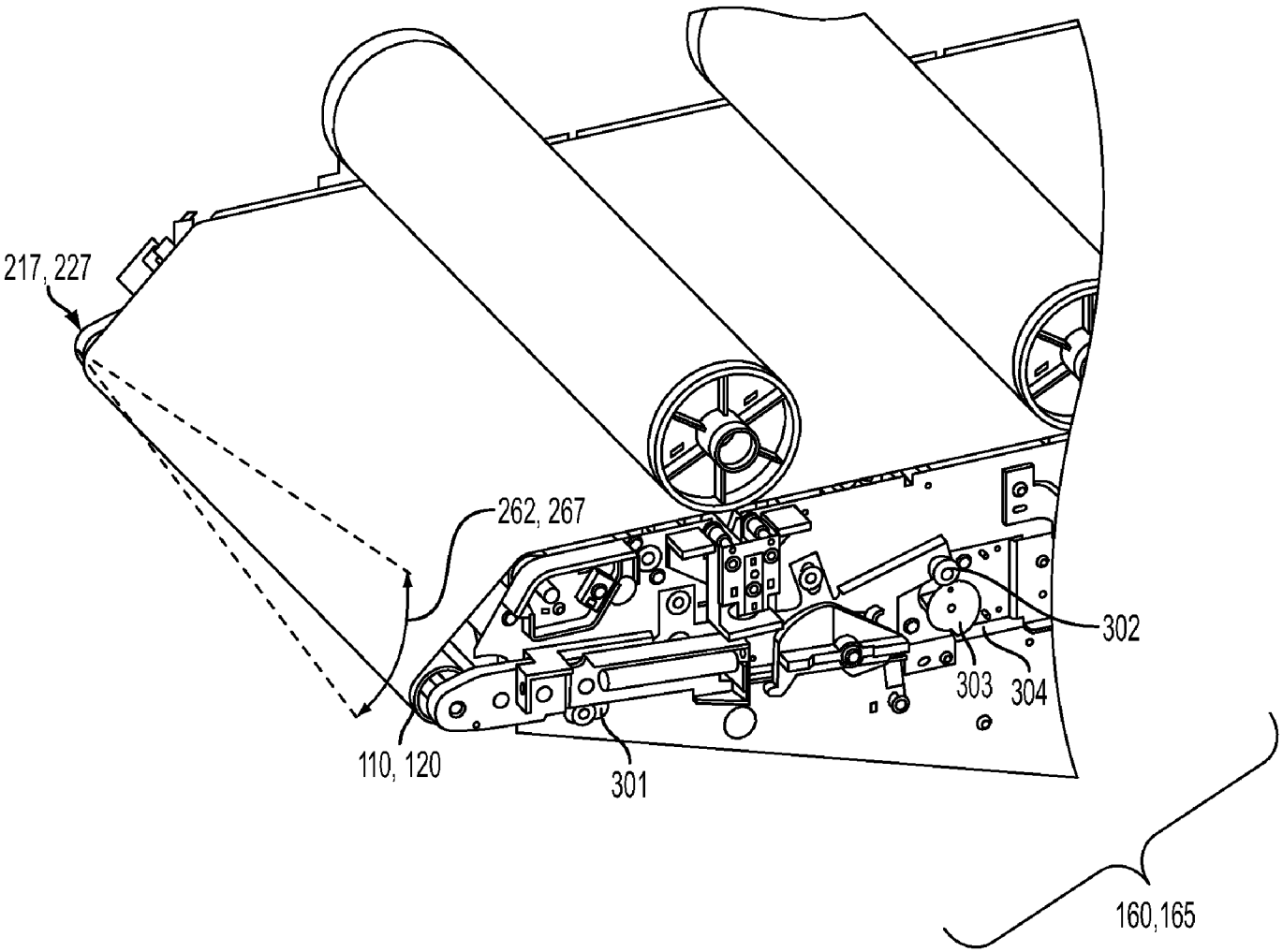
FIG. 3 is a schematic diagram of an exemplary steering mechanism.

Suitable steering mechanisms 160, 165 can comprise, for example, cam-follower systems. Specifically, referring to FIG. 3 in combination with FIGS. 1, 2*a* and 2*b*, the tilt of a steering roller 110, 120 can be actuated by a cam-follower system 160, 165. In such a system, rotation of a cam 303 is controlled by a stepper motor 304. As the cam 303 rotates, it engages a follower plate 302 attached to a steering link 301. Next, the steering link 301 moves the steering roller 110, 120 such that it pivots about the pivot point 217, 227 within the pivot angle range 262, 267. A similar cam-follower system is disclosed in detail in U.S. Pat. No. 5,248,027, incorporated by reference above. Alternatively, other suitable tilt mechanisms can be employed, for example, solenoid-spring systems, as disclosed in detail in U.S. Pat. No. 5,225,877, also incorporated by reference above.

In order to maintain lateral alignment of the belt 101 as it travels in a given direction 180 over the rollers 110, 120, one or more controllers 169 are used to control the movement (i.e., the tilting or pivoting) of the first steering roller 110 with respect to the first pivot point 216 as well as to control movement (i.e., the tilting or pivoting) of the second steering roller 120 with respect to the second pivot point 226. The different apparatus embodiments disclosed herein vary with respect to how movement of the first and second steering rollers 110, 120 about their respective pivot points 216, 226 is controlled: independently or dependently.

In one embodiment, the apparatus can comprise a first sensor 155 and a second sensor 156. The first sensor 155 can be positioned at a first location adjacent to the first steering roller 110 and the second sensor 156 can be positioned at a second location 152 adjacent to the second steering roller 120. The first sensor 155 can determine (i.e., sense, measure, etc.) the position of a lateral edge of the belt 101 at the first location 151 (i.e., can determine a first lateral position of the belt). The first sensor 155 can communicate the first lateral position to a controller. The controller can compare the first lateral position to a desired position for the lateral edge of the belt 101 at that first location 151. Then, the controller can determine a first pivot angle for moving (i.e., tilting or pivoting) the first steering roller 110 in order to return the belt 101 and, more particularly, to return the lateral edge of the belt at the first location 151 to the desired position. Similarly, a second sensor 156 can determine (i.e., sense, measure, etc.) the position of the same lateral edge of the belt 101 at a second location 152 adjacent to the second steering roller 120 (i.e., can determine a second lateral position of the belt). The second sensor 156 can communicate the second lateral position to a controller. The controller can compare the second lateral position to the desired position for lateral edge of the belt 101 at that second location 152. Then, the controller can determine a second pivot angle for moving (i.e., tilting or pivoting) the second steering roller in order to return the lateral edge of the belt at the second location to the desired position.

In this embodiment, either the same controller 169 (as illustrated) or discrete controllers (i.e., a first controller for controlling tilt of the first steering roller 110 and a second controller for controlling tilt of the second steering roller 120, not shown) can be used to compare the measured first and second lateral positions to the desired positions and to determine the required pivot angles. However, such processes are performed independently. That is, the determined pivot angle for the first steering roller 110 is not dependent on the determine pivot angle for the second steering roller 120 or vice versa.

Once the controller(s) 169 determine the required pivot angles for the first and second steering rollers 110, 120, the controller(s) 169 can control the corresponding first and second actuators 160, 165 accordingly in order to move (i.e., tilt, pivot, etc.) the first and second moveable ends 214, 224 to the determined first and second pivot angles, respectively, and, thereby to adjust belt positioning. Consequently, in this embodiment, the first lateral position of the belt 101 at the first location 151 and the second lateral position of the belt 101 at the second location 152 are independently adjusted. It should be noted, however, that a printing apparatus according to this embodiment (i.e., a printing apparatus wherein belt edge adjustment is performed independently at multiple locations) is enhanced when the nips 142 for the multiple imaging stations 140 effectively isolate any edge position corrections made by the steering rollers 110, 120. That is, since there is a normal load applied to the ITB 101 at each imaging station location 140 by the force of the imaging station back up roll 142 against the photoreceptor drum 195, through the ITB 101, the lateral motion of the ITB is damped. This would cause the lateral motion of the belt from the first steering roll 110 to the second steering roll 120 to transfer more slowly than it would otherwise, and improve the chances of developing two independent steering controllers that do not conflict with each other.

Alternatively, in another embodiment, a plurality of sensors can determine (i.e., measure, sense, etc.) the positions of the lateral edge of the belt 101 at multiple locations. For example, a first sensor 155 can determine a first lateral position of the edge of the belt 101 at a first location 151 adjacent to the first steering roller 110, a second sensor 156 can determine a second lateral position of the edge of the belt 101 at a second location 152 adjacent to the second steering roller 120, and (optionally) additional sensors 157 can determine additional lateral positions of the edge of the belt 101 at additional locations 153 (e.g., between each imaging station 140). The sensors 155, 156 (and, optionally, 157) can communicate these lateral positions to a single controller 169. The single controller 169 can compare the positions of the lateral edge of the belt 101 at the multiple locations 151, 152 (and, optionally, 153), as measured, to desired positions for the lateral edge of the belt 101 at these multiple locations. Then, in order to return the belt 101 and, more particularly, the lateral edge of the belt 101 at these multiple locations to the desired positions, the controller 169 can determine a first pivot angle for the first steering roller 110 and a second pivot angle for the second steering roller 120. This determination can be made by the controller 169 based on the predictable impact of movement of both the first steering roller 110 and the second steering roller 120 on belt edge positioning. That is, correcting the position of the belt edge at one location (e.g., 151) by moving a steering roller (e.g., 110) may have a predictable impact on the positioning of the belt edge at another location (e.g., 152) and vice versa. Thus, the best pivot angles for moving the first and second steering rollers 110, 120 in order to achieve the desired lateral belt alignment can be determined based on knowledge of the relationship between the two steering rollers 110, 120 and how their movement in combination will impact belt positioning.

Once the controller 169 determines the required pivot angles for the first and second steering rollers 110, 120, the controller 169 can control the corresponding first and second actuators 160, 165 accordingly in order to move (i.e., tilt, pivot, etc.) the first and second moveable ends 214, 224 (as shown in FIGS. 2*a-b*) to the first and second pivot angles, respectively, and, thereby to adjust belt positioning. Consequently, in this embodiment, the first lateral position of the belt 101 at the first location 151 and the second lateral position of the belt 101 at the second location 152 are dependently adjusted.

Suitable sensors 156-157 can comprise, for example, any known optical or other belt edge sensors, having single or multiple-array photodetectors and/or a marks-on-belt (MOB) sensor. Exemplary belt edge sensors are discussed in detail in the following U.S. patents assigned to Xerox Corporation of Norwalk, Conn. and incorporated herein in their entirety by reference: U.S. Pat. No. 6,594,460 of Williams, et al., issued on Jul. 15, 2003; U.S. Pat. No. 6,369,842 of Abramsohn, issued on Apr. 9, 2002; U.S. Pat. No. 6,275,244 of Omelchenko, et al., issued on Aug. 14, 2001; and U.S. Pat. No. 6,300,968 of Kerxhalli, et al., issued on Oct. 9, 2001).

Figure 4A:
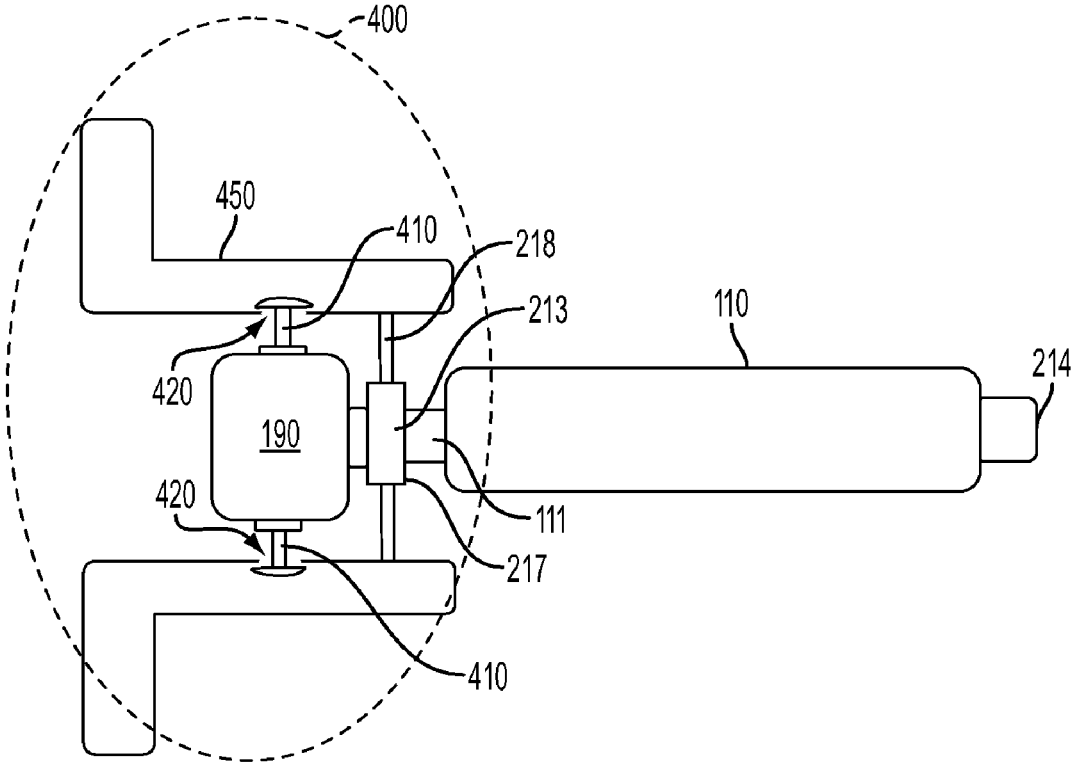
FIG. 4*a* is a schematic diagram of an exemplary drive motor mount.

In order to optimize space within the apparatus 100 embodiments described above, one of the steering rollers (e.g., the first steering roller 110) can further be configured as a drive roller. Rotation of the steering/drive roller 110 in a given direction 180 (e.g., a counter clockwise direction or, alternatively, a clockwise direction) will cause the belt 101 to travel in that same direction 180. Movement of the belt 101 in turn can cause the second steering roller 120 to rotate. In order to configure the first steering roller 110 as a drive roller, a drive motor 190 must be operatively connected to the first axle 111 adjacent to the first fixed end 213 so as to rotate the first steering roller 110. In this case, the apparatus 100 must further comprise a flexible mount 400, as illustrated in FIG. 4*a*, for mounting the drive motor 190 and for further allowing for movement of the first steering roller 110 with respect to the first pivot point 216 in the presence of the drive motor 190. This flexible mount 400, which secures the drive motor 190 within the printing apparatus 100 adjacent to the first steering roller 110, must be adapted to allow either the entire mount itself or the drive motor 190 within the mount 400 to move (i.e., to be tilted or pivoted) in conjunction with the movement of first steering roller 110 and, more particularly, in conjunction with movement of the first movable end 214 of the first axle 111 of the first steering roller 110.

Figure 4B:
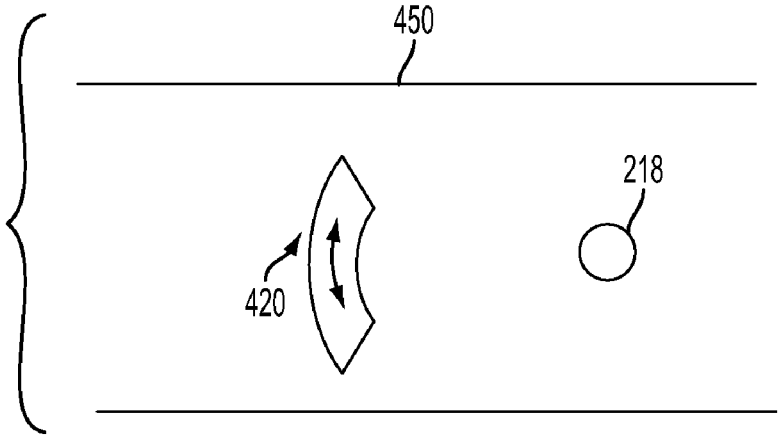
FIG. 4*b* is a schematic diagram of a portion of the drive motor mount of FIG. 4*a;*

For example, referring to FIG. 4*a*, a flexible mount 400 can comprise a bracket 450. The end 213 of the axle 111 of the first steering roller 110 can extend through a bushing 217 and connect to the drive motor 190, thereby allowing the axle 111, when driven by the motor 190, to rotate freely within the bushing 217. Pin(s) 218 can connect the bushing 217 to the bracket 450, thereby allowing the axle 111 to pivot at end 213 about the pin(s) 218. Additionally, one or more rods 410 can secure the motor 190 to the bracket 450. Specifically, rods 410 can extend from opposite sides of the motor 190 and can be oriented approximately perpendicular to the roller 110. Each rod 410 can further be configured to engage a slide track (i.e., slot) 420 within the bracket 450 (see FIG. 4*b*). The size and shape of the slide track 420 are predetermined based on the required rotation of the motor 190 in conjunction with tilting of the roller 110 by the tilt mechanism 160. Thus, as the moveable end 214 is moved, causing the axle 111 to pivot around the pin(s) 218, the motor 190 can also move as guided and supported by the rods 410 within the slide track 420.

It should be understood that the terms "printing device", "printing engines", "printing apparatus" and/or "printer" as used herein encompasses any of a digital copier, bookmaking machine, facsimile machine, multi-function machine, etc. which performs a print outputting function for in the manner described above using one or more intermediate transfer belt. The details of printing devices (e.g., printers, printing engines, etc.) are well-known by those ordinarily skilled in the art. Printing devices are readily available devices produced by manufactures such as Xerox Corporation, Norwalk, Conn., USA. Such printing devices commonly include input/output, power supplies, processors, media movement devices, marking devices etc., the details of which are omitted from here to allow the reader to focus on the salient aspects of the embodiments described herein. The term "print medium" as used herein encompasses any cut sheet or roll of print media substrate suitable for receiving images, such as, a paper, plastic, vinyl, etc.

It should further be understood that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein should not be implied or imported from any above example as limitations to any particular order, number, position, size, shape, angle, color, or material.

Therefore, disclosed above are embodiments of an apparatus that uses multiple belt steering systems to control and maintain lateral alignment of an endless belt. In each of the embodiments, the position of the lateral edge of the belt is measured by multiple belt edge sensors and then corrected by at least two steering rollers connected to corresponding belt steering mechanisms. The belt steering mechanisms tilt the rollers in order to adjust the lateral position of the belt at multiple locations. The steering mechanisms for the rollers can be controlled independently with the tilt of each steering roller being adjusted based solely on information obtain from a corresponding belt edge sensor. Alternatively, the steering mechanisms for the rollers can be controlled dependently with the tilt of each steering roller being adjusted based on information obtain from multiple sensors at multiple locations and further based on the predictable impact of the simultaneous movement of both rollers on belt positioning. In addition, to save space, at least one of the steering rollers can also be configured as a drive roller that causes the belt to travel in a given direction.

In a printing apparatus, which incorporates multiple belt steering systems as described above for controlling lateral alignment of an intermediate transfer belt (ITB), belt edge alignment is maintained more uniformly around the belt circumference so that color-to-color registration and image on paper registration are improved. Specifically, these embodiments ensure that skew along the section of an ITB adjacent to the imaging stations is minimized, thereby minimizing color-to-color registration errors. Furthermore, since the ITB acts mostly as a rigid body, by maintaining edge position of the ITB at the two steering locations, skew along the section of the ITB adjacent to the BTP transfer station is also minimized, thereby minimizing IOP errors.

What is claimed is:

1. An apparatus comprising:

a first roller having a first axle and a first outer surface, said first axle having a first fixed end and a first movable end;

a second roller having a second axle and a second outer surface, said second axle having a second fixed end and a second movable end, said first roller and said second roller being located at different positions;

a belt supported by said first roller and said second roller, said belt having an inner surface contacting said first outer surface of said first roller and said second outer surface of said second roller;

a first sensor at a first location adjacent said first roller, said first sensor measuring a first lateral position of said belt at said first location;

a second sensor at a second location adjacent said second roller, said second location being different from said first location along a length of said belt and said second sensor measuring a second lateral position of said belt at said second location;

a plurality of additional sensors at additional locations between said first location and said second location along said length of said belt, said additional sensors measuring additional lateral positions of said belt at said additional locations; and a controller in communication with said first sensor, said second sensor, and said additional sensors, said controller further being operatively connected to said first axle and said second axle, said controller causing movement of said first movable end and movement of said second movable end in order to selectively adjust said first lateral position of said belt at said first location and said second lateral position of said belt at said second location and, as a result, to adjust said additional lateral positions of said belt at said additional locations such that a desired lateral edge belt alignment is achieved.

2. The apparatus of claim 1, further comprising:

a first actuator connected to and moving said first movable end; and a second actuator connected to and moving said second movable end, said first actuator and said second actuator being controlled by said controller.

3. The apparatus of claim 2, said first actuator and said second actuator each comprising cam-follower systems.

4. The apparatus of claim 1, further comprising:

a drive motor operatively connected to said first axle adjacent said first fixed end so as to rotate said first roller; and a flexible mount connected to said drive motor, said flexible mount allowing for movement of said drive motor in conjunction with said movement of said first movable end.

5. The apparatus of claim 1, said first sensor and said second sensor comprising belt edge sensors.

6. The apparatus of claim 1, said controller determining an optimum pivot angles for said first movable end and said second movable end in order to achieve said desired lateral edge belt alignment.

7. The apparatus of claim 1, said controller causing said movement of said first movable end and said movement of said second movable end so as to dependently adjust said first lateral position of said belt at said first location and said second lateral position of said belt at said second location.

8. An apparatus comprising:

a first roller having a first axle and a first outer surface, said first axle having a first fixed end and a first movable end;

a drive motor operatively connected to said first axle adjacent said first fixed end so as to rotate said first roller;

a second roller having a second axle and a second outer surface, said second axle having a second fixed end and a second movable end, said first roller and said second roller being located at different positions;

a belt supported by said first roller and said second roller, said belt having an inner surface contacting said first outer surface of said first roller and said second outer surface of said second roller;

a first sensor at a first location adjacent said first roller, said first sensor measuring a first lateral position of said belt at said first location;

a second sensor at a second location adjacent said second roller, said second sensor measuring a second lateral position of said belt at said second location; and a first controller in communication with said first sensor and operatively connected to said first axle, said first controller causing movement of said first movable end so as to adjust said first lateral position of said belt at said first location; and a second controller independent of said first controller, said second controller in communication with said second sensor and operatively connected to said second axle, said second controller causing movement of said second movable end so as to adjust said second lateral position of said belt at said second location.

9. The apparatus of claim 8, further comprising:

a first actuator connected to and moving said first movable end, said first actuator being controlled by said first controller; and a second actuator connected to and moving said second movable end, said second actuator being controlled by said second controller.

10. The apparatus of claim 8, further comprising:

a flexible mount connected to said drive motor, said flexible mount allowing for movement of said drive motor in conjunction with said movement of said first movable end.

11. A printing apparatus comprising:

a first roller having a first axle and a first outer surface, said first axle having a first fixed end and a first movable end;

a drive motor operatively connected to said first axle adjacent said first fixed end so as to rotate said first roller;

a second roller having a second axle and a second outer surface, said second axle having a second fixed end and a second movable end, said first roller and said second roller being located at different positions;

an intermediate transfer belt traveling over said first roller and said second roller in a given direction, said intermediate transfer belt having an inner belt surface and an outer belt surface, said inner belt surface contacting said first outer surface of said first roller and said second outer surface of said second roller;

a plurality of imaging stations adjacent to said outer belt surface as said intermediate transfer belt travels from said first roller towards said second roller in said given direction;

a belt-to-print medium transfer station adjacent said outer belt surface as said intermediate transfer belt travels from said second roller towards said first roller in said given direction;

a first sensor at a first location adjacent said first roller, said first sensor measuring a first lateral position of said belt at said first location;

a second sensor at a second location adjacent said second roller, said second sensor measuring a second lateral position of said belt at said second location; and at least one controller in communication with said first sensor and said second sensor and operatively connected to said first axle and said second axle, said at least one controller causing movement of said first movable end and movement of said second movable end so as to adjust said first lateral position of said belt at said first location and said second lateral position of said belt at said second location.

12. The printing apparatus of claim 11, further comprising:

a first actuator connected to and moving said first movable end; and a second actuator connected to and moving said second movable end, said first actuator and said second actuator being controlled by said at least one controller.

13. The printing apparatus of claim 11, further comprising:

a flexible mount connected to said drive motor, said flexible mount allowing for movement of said drive motor in conjunction with said movement of said first movable end.

14. The apparatus of claim 11, said at least one controller causing said movement of said first movable end and said movement of said second movable end so as to independently adjust said first lateral position of said belt at said first location and said second lateral position of said belt at said second location.

15. The printing apparatus of claim 11, said at least one controller causing said movement of said first movable end and said movement of said second movable end so as to dependently adjust said first lateral position of said belt at said first location and said second lateral position of said belt at said second location.

16. A printing apparatus comprising:

a first roller having a first axle and a first outer surface, said first axle having a first fixed end and a first movable end;

a drive motor operatively connected to said first axle adjacent said first fixed end so as to rotate said first roller;

a second roller having a second axle and a second outer surface, said second axle having a second fixed end and a second movable end, said first roller and said second roller being located at different positions;

an intermediate transfer belt traveling over said first roller and said second roller in a given direction, said intermediate transfer belt having an inner belt surface and an outer belt surface, said inner belt surface contacting said first outer surface of said first roller and said second outer surface of said second roller;

a plurality of imaging stations adjacent said outer belt surface as said intermediate transfer belt travels from said first roller towards said second roller in said given direction;

a belt-to-print medium transfer station adjacent said outer belt surface as said intermediate transfer belt travels from said second roller towards said first roller in said given direction;

a first sensor at a first location adjacent said first roller, said first sensor measuring a first lateral position of said belt at said first location;

a second sensor at a second location adjacent said second roller, said second sensor measuring a second lateral position of said belt at said second location; and at least one controller in communication with said first sensor and said second sensor and operatively connected to said first axle and said second axle, said at least one controller causing movement of said first movable end and movement of said second movable end so as to adjust said first lateral position of said belt at said first location and said second lateral position of said belt at said second location, and said drive motor being flexibly mounted so as to allow for movement of said drive motor in conjunction with said movement of said first movable end.

17. The printing apparatus of claim 16, further comprising:

a first actuator connected to and moving said first movable end; and a second actuator connected to and moving said second movable end, said first actuator and said second actuator being controlled by said at least one controller.

18. The printing apparatus of claim 16, said at least one controller causing said movement of said first movable end and said movement of said second movable end so as to independently adjust said first lateral position of said belt at said first location and said second lateral position of said belt at said second location.

19. The printing apparatus of claim 16, said at least one controller causing said movement of said first movable end and said movement of said second movable end so as to dependently adjust said first lateral position of said belt at said first location and said second lateral position of said belt at said second location.

20. The printing apparatus of claim 16, said printing apparatus comprising one of an electrostatic and xerographic printer.

* * * * *